United States Patent [19]

Kuna et al.

[11] 4,266,367

[45] May 12, 1981

[54] SITTING DOLL

[75] Inventors: Wayne A. Kuna, Elmhurst; Allison W. Katzman; Rouben T. Terzian, both of Chicago, all of Ill.

[73] Assignee: Marvin Glass & Associates, Chicago, Ill.

[21] Appl. No.: 8,519

[22] Filed: Feb. 1, 1979

[51] Int. Cl.[3] ..... A63H 11/14

[52] U.S. Cl. ..... 46/149

[58] Field of Search ..... 46/149, 129, 118, 119, 46/120, 150

[56] References Cited

U.S. PATENT DOCUMENTS

| | | | |
|---|---|---|---|
| 1,352,933 | 9/1920 | Arnold | 46/149 |
| 1,582,778 | 4/1926 | Parsons | 46/118 |
| 2,596,491 | 5/1952 | Kinberg | 46/119 |
| 2,804,720 | 9/1957 | Olson | 46/118 X |
| 2,885,824 | 5/1959 | Lemelson | 46/118 |
| 3,195,270 | 7/1965 | Glass et al. | 46/150 X |
| 3,287,847 | 11/1966 | Gardel et al. | 46/118 |
| 3,591,976 | 7/1971 | Ostrander | 46/149 |

FOREIGN PATENT DOCUMENTS

| | | | |
|---|---|---|---|
| 192818 | 11/1957 | Austria | 46/149 |

*Primary Examiner*—F. Barry Shay

*Attorney, Agent, or Firm*—Mason, Kolehmainen, Rathburn & Wyss

[57] ABSTRACT

An articulated doll including an internal arrangement for allowing the doll to sit down from a standing position without the assistance of the doll user. With the doll in a standing position and the arms upright, the user rotates the arms to a down position and then releases the arms. After a predetermined time interval, the internal arrangement of the doll causes the doll to move from the standing position to a sitting position. When the doll is returned to a standing position, a control mechanism located on the doll torso is actuated to lock the legs of the doll to a standing position. The doll is also capable of being walked by the user holding the doll by the arms and alternately lifting one leg and then the other off the walking surface. The leg lifted from the walking surface pivots and the doll takes a step.

17 Claims, 8 Drawing Figures

Fig 5
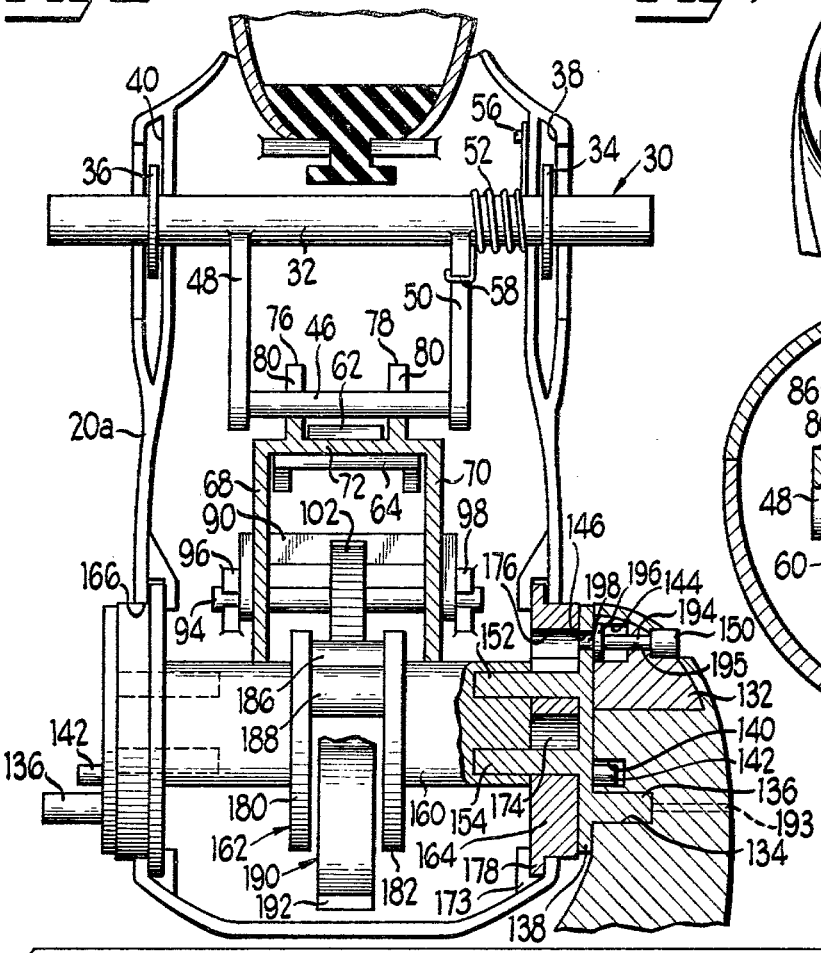
Fig 7
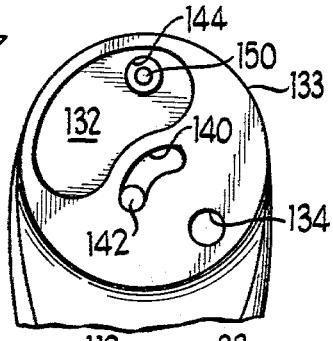
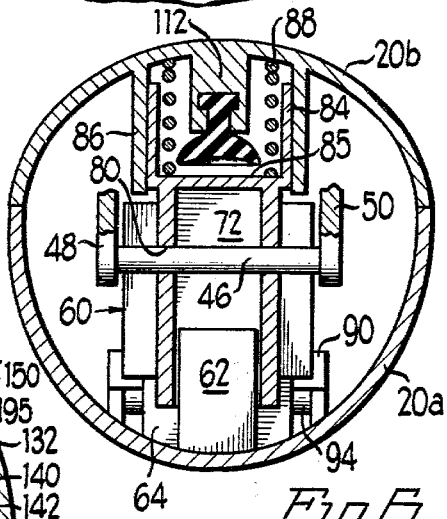
Fig 6
Fig 8
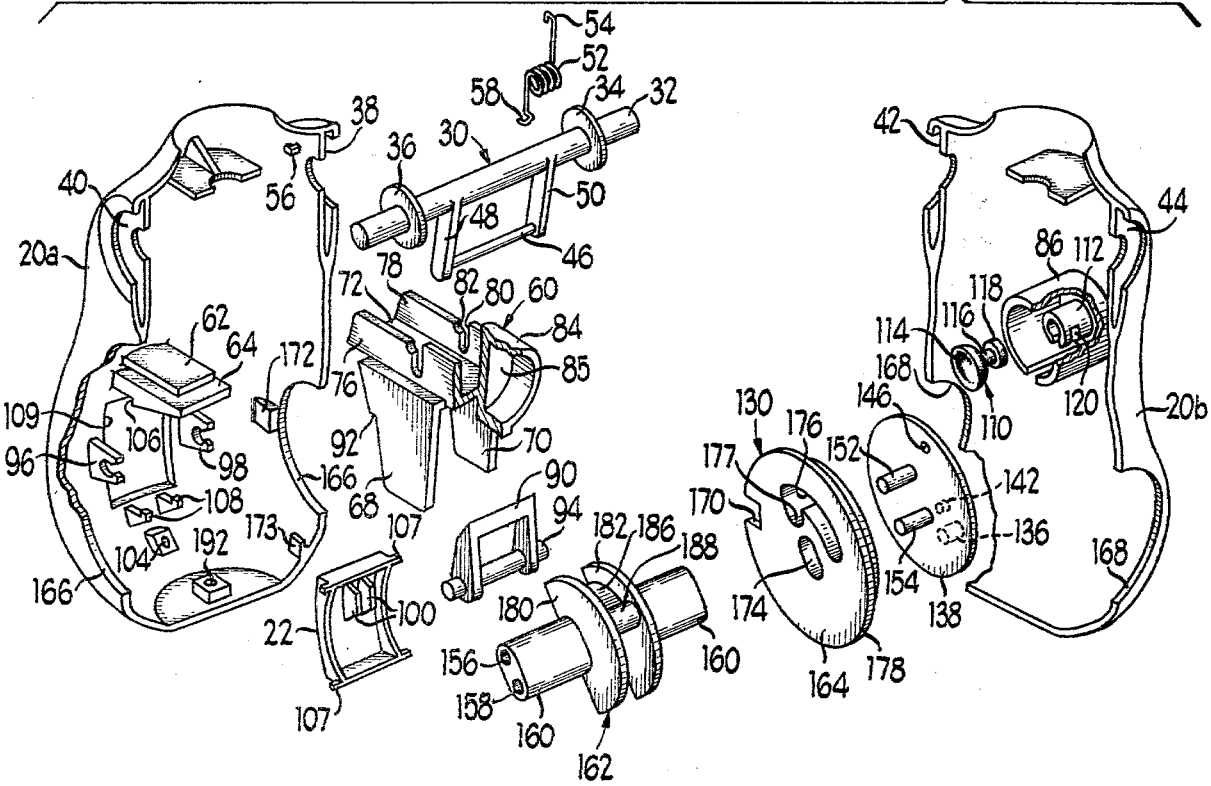

SITTING DOLL

BACKGROUND OF THE INVENTION

This invention relates to articulated dolls and more particularly to a doll that is capable of moving from a standing to a sitting position without the assistance of the user.

There are various articulated action dolls and toys that are capable of various movements by means of internal arrangements. For example, action toys and dolls of this general type are disclosed in U.S. Pat. No. 3,287,847 which issued to R. Gardel et al on Nov. 29, 1966; U.S. Pat. No. 2,885,824 which issued to J. H. Lemelson on May 12, 1959; U.S. Pat. No. 2,804,720 which issued to C. W. Olson on Sept. 3, 1957; and U.S. Pat. No. 2,596,491 which issued to B. Kinberg on May 13, 1952.

The action doll described in U.S. Pat. No. 3,287,847 relates to a mechanically actuated doll that is mechanized to move from one position to another without being touched. The particular doll disclosed therein is placed in a lying down position in a specially prepared crib or basket. When the mechanism is set to operate, the doll will lie still for a noticeable period of time and will then proceed to sit up. The doll also emits a crying sound while sitting up. When the doll is placed in a flat lying position, a suction cup 32 is pressed against an area of the body wall 33 causing it to take hold. The doll remains lying down until the suction in the suction cup 32 is relieved. When the suction cup releases, the elastic or spring member 34 pulls the body up to a sitting position. The sitting up action of the doll is operated by the torso being moved with respect to an operative leg member. The operative leg member is held at the foot to a surface of the crib or basket. If the doll is held erect while the suction cup is set and released, the moving leg will give a vigorous kick to a ball or any other object in front of it.

U.S. Pat. No. 2,885,824 describes a jumping dog that emits a sound and jumps a delayed time period after the dog has been set or cocked. A suction cup 14 is utilized to hold the toy to a set position and release of the suction cup causes the dog to jump.

U.S. Pat. No. 2,804,720 describes an animated doll having a clock motor associated with the limbs of the doll. Upon winding of the motor by squeezing the flexible body of the doll, the limbs of the doll are caused to oscillate to simulate movement of a human baby.

U.S. Pat. No. 2,596,491 describes a doll including pivotal legs and an apparatus for normally urging the body portion of the doll from a position of longitudinal alignment with the legs into a position where the body is approximately at a right angle to the legs. Thus, for example, if the doll is placed in a lying position, after a time delay the doll will sit up. A piston cylinder arrangement is provided in the doll to control the sitting up of the doll. The legs of the doll are weighted to prevent the legs from rising and causing the body to pivot about the axis of connection between the legs and the body.

While the aforementioned dolls and toys provide amusement to the user, there is a constant need for new and improved articulated dolls capable of performing movement without the assistance of the user to provide entertainment to the user.

SUMMARY OF THE INVENTION

The present invention provides a new and improved articulated doll capable of moving from a standing to a sitting position without the assistance of the user.

Briefly, in accordance with a preferred embodiment of the present invention, an articulated doll is provided including an internal arrangement for allowing the doll to sit down from a standing position without the assistance of the doll user. With the doll in a standing position and the arms upright, the user rotates the arms to a down position and then releases the arms. After a predetermined time interval, the internal arrangement of the doll causes the doll to move from the standing position to a sitting position. When the doll is returned to a standing position, a control mechanism located on the doll torso is actuated to lock the legs of the doll to a standing position. The doll is also capable of being walked by the user holding the doll by the arms and alternately lifting one leg and then the other off the walking surface. The leg lifted from the walking surface pivots and the doll takes a step.

Various objects, features and advantages of the present invention will become apparent from the following detailed description taken in conjunction with the accompanying drawings.

BRIEF DESCRIPTION OF THE DRAWINGS

FIG. 5 is a fragmentary, enlarged view partly in section and with parts broken away taken from the rear of the standing doll of FIG. 1 and taken generally along a vertical line through the center of the doll illustrating the features of the present invention;

FIG. 6 is a fragmentary sectional view taken along the line 6—6 of FIG. 3;

FIG. 7 is a fragmentary elevational and illustrating the details of the left leg of the doll; and FIG. 8 is an exploded perspective view of the torso of the doll of FIG. 1 illustrating the details of the various operative assemblies of the doll with the rear portion of the torso pivoted at approximately 90° from the alignment position with cam follower 190 omitted for clarity.

DESCRIPTION OF THE PREFERRED EMBODIMENT

Figure 1:
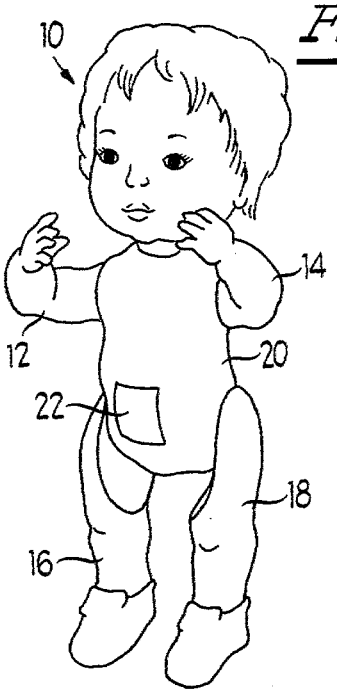
FIG. 1 is a perspective view of the articulated doll of the present invention and shown in the standing or upright position.
Figure 2:
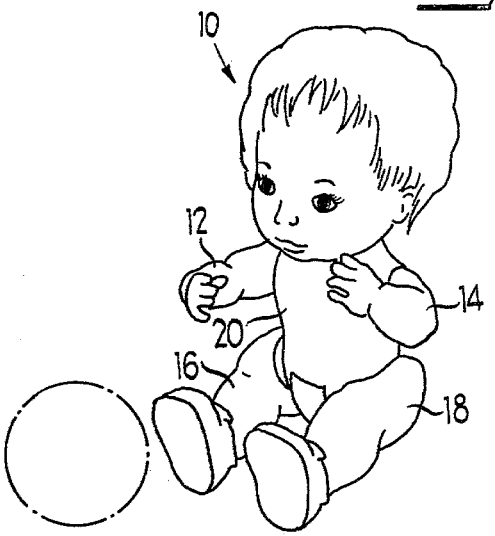
FIG. 2 is a perspective view of the articulated doll of FIG. 1 and shown in the sitting position.

Referring now to FIGS. 1 and 2, the articulated doll of the present invention generally referred to at 10 includes articulated right and left arm members 12, 14 respectively and right and left leg members 16, 18 respectively supported on the doll torso 20. A simulated human head member 24 is rotatably carried by the doll torso 20. The doll 10 is capable of moving from the standing position of FIG. 1 to the sitting position of FIG. 2 without the assistance of the child playing with the doll.

In the standing position of FIG. 1, a control panel 22 located on the front of the torso 20 is actuated to lock the legs 16, 18 in the standing position. When the user of the doll desires that the doll move from the standing position of FIG. 1 to the sitting position illustrated in FIG. 2, the interconnected arm members 12, 14 are rotated downward from the raised position in FIG. 1. Then the user releases the arms. After a predetermined time delay, the operative arrangements internal to the doll 10 cause the doll to assume the sitting position of FIG. 2.

The doll 10 is also capable of being walked by the user. A control pin, discussed in more detail hereinafter, is positioned to the walking position. To accomplish walking of the doll 10, the user holds the arm members 12, 14 and maneuvers the doll so that the leg members 16, 18 are alternately lifted off the walking surface. As the leg members 16, 18 are lifted from the walking surface, the respective lifted leg moves forward to take a step. Thus, alternate lifting of the leg members 16, 18 causes the doll to walk while the user holds the doll by the arm members 12, 14.

Turning now to a more detailed discussion of the internal arrangements of the doll to accomplish sitting movement and walking and referring now additionally to FIGS. 3 through 8, the arm members 12, 14 are interconnected to an actuator assembly referred to generally at 30 and best seen in FIGS. 5 and 8. The actuator assembly 30 includes an arm interconnecting rod 32 extending through the torso 20 of the doll and fixedly connected through the arm members 12, 14 at either end of the rod 32. The arm interconnecting rod 32 is rotatably supported within the torso 20 by means of disc portions 34, 36 spaced along the rod 32. The disc portions 34, 36 are aligned respectively with two receiving sockets 38, 40 on the front torso portion 20*a* of the torso 20 and two receiving sockets 42, 44 of the rear portion 20*b* of the torso 20. Upon assembly of the front and rear torso portions 20*a*, 20*b*, the actuator assembly 30 is rotatably supported within the torso 20. The actuator assembly 30 also includes an actuator rod 46 spaced from the arm interconnecting rod 32 by spacer bars 48, 50 extending from the rod 32. A spring 52 is positioned on the arm interconnection rod 32 and rotatably biases the actuator assembly 30 and attached arm members 12, 14 to the raised upward position. The spring 52 includes a spring attachment arm 54 positioned over a hook lug 56 that is formed on the front torso portion 20*a*. A second attachment arm 58 is positioned around the spacer bar 50.

Upon the downward rotation of the arm members 12, 14, the actuator rod 46 of the actuator assembly 30 engages a movable sitting control mechanism referred to generally at 60. As the arm members 12, 14 and the actuator assembly 30 is rotated from a raised arm position to a lowered arm position, the actuating rod 46 conditions the sitting mechanism 60 from a first central position to a second rearward position to actuate the start of the sitting sequence.

Considering the sitting mechanism 60 more specifically, the sitting mechanism 60 is slidably supported on the front torso portion 20*a* between spaced apart guide ledges 62, 64 extending from the front torso portion 20*a*. Specifically, the base portion of the sitting mechanism 60 is a generally U-shaped member with spaced apart legs 68, 70 and a central portion 72 spanning the legs 68, 70. The spaced apart legs 68, 70 span the width of the lower extending guide ledge 64 and the central portion 72 is received between the extending guide ledges 62, 64. Extending upward from the central portion 72 of the sitting mechanism 60 are spaced apart walls 76, 78 each having formed therethrough a receiving slot 80 arranged to accept the actuator rod 46. The receiving slot 80 is a generally U-shaped slot with a widened curved portion 82 at the front of the slot 80. Extending toward the rear torso portion 20*b*, the sitting mechanism 60 includes a tubular section 84 having a cylindrical wall portion and a base 85 extending from the rear of the spaced apart wall members 76, 78. The tubular section 84 extends toward the rear torso portion 20*b*. The tubular section 84 is received within a somewhat larger cylindrical receiving wall 86 extending from the rear torso portion 20*b*.

Thus, the sitting mechanism 60 is supported between the front torso portion 20*a* and the rear torso portion 20*b*. The sitting mechanism 60 is biased to a third forward position illustrated in FIG. 4 by means of a coil spring 88. The coil spring 88 is positioned within the tubular section 84 between the base 85 of the tubular section 84 and the rear torso portion 20*b*.

Figure 3:
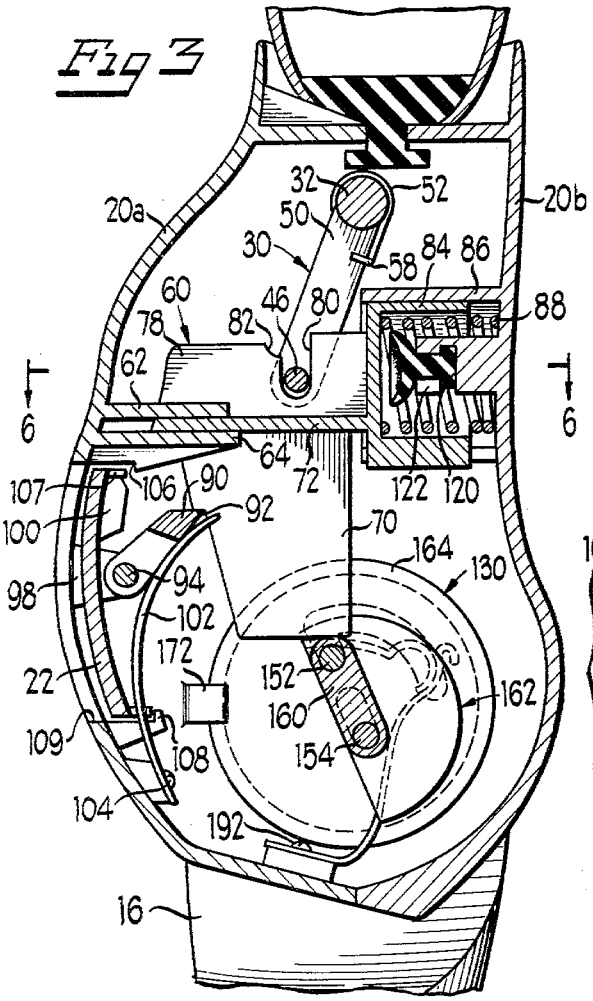
FIG. 3 is a fragmentary, enlarged vertical sectional view taken from the left side of the upstanding doll of FIG. 1 and taken generally along a vertical line through the center of the doll illustrating the features of the present invention.

With the doll in the standing position, FIG. 3, the sitting mechanism 60 is latched or held in the central position by the interfitting of a pawl member 90 and a notched portion 92 formed in each of the spaced apart legs 68, 70. The pawl 90 is rotatably carried by the front torso portion 20*a*. Specifically, the pawl 90 includes a pawl rod 94 received within sockets 96, 98 on the front torso portion 20*a*.

The pawl 90 is operated by the control panel 22 including spaced apart and extending actuating members 100 operating against the pawl 90. A planar strip spring 102 is affixed at a lower end to the front torso portion 20*a* at 104. An upper free end of the spring 102 is engaged by the pawl 90 and fits between the spaced legs 68, 70 of the sitting mechanism 60. Rearward movement of the control panel 22 is restricted upon contact with a notched portion 106 of the lower guide ledge 64 and two hooks 108 extending from the front torso portion 20*a* and located below the control panel 22. The control panel 22 is positioned through a similarly shaped cutout 109 in the front torso portion 20*a*. Forward movement of the control panel 22 is restricted by protruding ears 107 extending from the four corners of the control panel 22.

In the forward most position of the sitting mechanism 60, the doll 10 is released to the sitting position of FIG. 2 as will be explained in detail hereinafter. In the central position illustrated in FIG. 3, the sitting mechanism 60 is latched by the pawl 90 to lock the leg members 16, 18 of the doll 10 to a standing position shown in FIG. 1. The sitting mechanism 60 is latched to the central position after the doll is placed in the standing position of FIG. 1 and the control panel 22 is operated to position the pawl 90 in the latched position.

Turning now to a discussion of operation to cause the doll to sit from the standing position of FIG. 1 wherein the sitting mechanism 60 is latched to the central position of FIG. 3, the arm members 12, 14 are rotated from the raised position to the downward position. As the arm members 12, 14 are rotated, the actuating rod 46 positions the sitting mechanism 60 to the rearward position (not shown).

In the rearward position of the sitting mechanism 60, the spring 88 is compressed and a suction cup arrangement 110 is contacted by the base 85 of the cylindrical wall 84. The suction cup arrangement 110 is retained within a socket 112 extending into the central portion of the cylindrical receiving wall 86 from the rear torso portion 20*b*. The suction cup arrangement 110 includes a cup portion 114 adjacent the base 85 of cylindrical wall 84, a narrow stem portion 116 and a widened base flange 118. The base flange 118 is received within a receiving passage 120 formed in the socket 112. The socket 112 is slotted at 122 to interconnect the receiving passage 120.

As the cup 114 of the suction cup arrangement 110 contacts the base 85 of the tubular section 84 of the sitting mechanism 60, a suction is created to hold the sitting mechanism 60 against the force of the compressed spring 88 to temporarily retain the sitting mechanism 60 in the rearward position. As the sitting mechanism 60 is moved to the rearward position, the planar strip spring 102 biases the pawl 90 out of the latching position.

The doll 10 remains in the standing position for a time interval after the user rotates the arm members 12, 14 to the lower position. The suction cup 114 retains the sitting mechanism 60 in the rearward position for a time interval dependent upon the suction created between the cup 114 and the sitting mechanism 60. Thus at this point, the legs 16, 18 remain in the standing position. As the suction releases between the cup 114 and the sitting mechanism 60 due to leakage around the cup 114 and under the force of the compressed spring 88, the sitting mechanism 60 moves toward the forward position shown in FIG. 4. As the sitting mechanism 60 moves forward, the leg members 16, 18 are released from the standing position and permitted to rotate by the release of a leg control arrangement generally referred to at 130.

The leg members 16, 18 are biased to a pivoted position at right angles to the torso 20 unless held to the standing position by the sitting mechanism 60. Thus, as the sitting mechanism 60 travels from the rearward position adjacent the suction cup 114 to the forward most position shown in FIG. 4, the leg control mechanism 130 is released and allows the legs 16, 18 to pivot. A change in position of the leg control mechanism 130 and a change in the center of gravity of the doll 10 causes the doll 10 to assume a sitting position shown in FIGS. 2 and 4.

The leg members 16, 18 referring to FIGS. 5 and 7 include a weighted section 132 arranged along the top and rearward portion of the leg members 16, 18 relative to the center of the circular section 133 defining the mounting surface of the leg members 16, 18 to the torso 20. A cylindrical recess 134 is formed in the circular mounting section 133 of the leg members 16, 18 for receiving a lower pin 136 of a leg control disc 138. An elongated kidney-shaped recess 140 is formed in the central mounting section 133 to provide a pivotal control surface for an interfitting guide pin 142 of the leg control disc 138. A circular recess 144 is formed within the weighted section 132 for alignment with a hole 146 through the leg control disc 138. A leg walking control pin 150 is received through the recess 144 and into the hole 146 as will be explained in detail hereinafter.

The leg control disc 138 also includes two spaced apart pins 152, 154 extending in a direction opposite the leg mounting surface 133. The extending pins 152, 154 are received within cylindrical sockets 156, 158 formed in an extending arm portion 160 of a centrally located leg control connecting member 162. The leg control connecting member 162 upon receiving the pins 152, 154 of the leg control disc 138 and attached leg members 16, 18 provides control of the leg members 16, 18.

The leg members 16, 18 are supported on the torso 20 by a flanged mounting disc 164 interfitting with a semicircular cutout portion 166 of the front torso 20*a* and a semicircular cutout portion 168 of the rear torso portion 20*b*. The torso mounting disc 164 includes a notch 170 for fixedly positioning the disc 164 within the torso by interconnecting with a stop tab 172 formed on the front torso portion 20*a*. The torso mounting disc 164 also includes an elongated central passage 174 to allow for free movement of the inserted pin 154 of the leg mounting disc 138 and an arcuate passage 176 to allow for free movement of the inserted pin 152. The passages 174, 176 are arranged to allow for unrestricted movement of pins 152, 154 as the leg mounting disc 138 pivots during the sitting and the walking operations about the fixed torso mounting disc 164. The torso mounting disc 164 is a generally cylindrical disc member with an enlarged base flange portion 178 arranged to interfit between the front torso portion 20*a*, stop tab 172 and a positioning tab 173. A leg control disc and a torso mounting disc 164 are provided for the left hand leg assembly similar to the right leg control disc 138 and the right torso mounting disc 164. The left leg control disc interfits with the extending arm portion 160 on the left side of the central leg control member 162.

The central leg control member 162 includes spaced semicircular portions 180, 182 with the extending arm portions 160 extending on either side of the central members 180, 182. The spaced semicircular portions 180, 182 are interconnected by a central portion (not shown) which comprises a curved cam member 186 having a hooked end portion 188 formed from a metal strip or the like mounted between the spaced members 180, 182. The hooked end portion 188 of the cam member 186 is positioned for operative engagement with a curved cam follower 190 formed by a metal spring strip or the like. The cam follower 190 is attached at 192 to the bottom of the front torso portion 20*a* and extends toward the rear torso portion 20*b*. The cam follower 190 includes a steeply curved portion at 194 and a hook portion 196.

Figure 4:
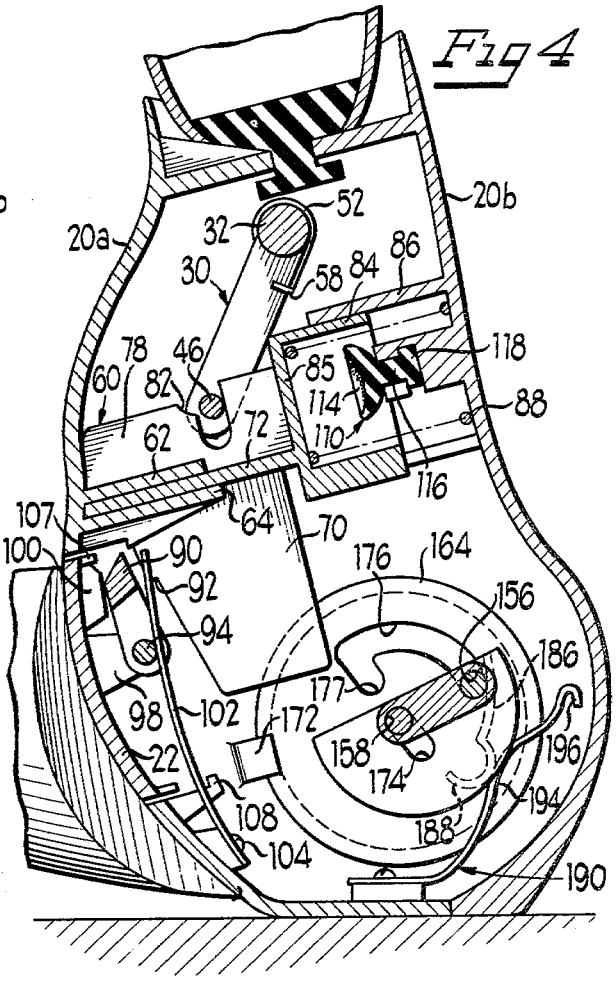
FIG. 4 is a fragmentary, enlarged vertical sectional view taken from the left side of the sitting doll of FIG. 2 and taken generally along a vertical line through the center of the doll illustrating the features of the present invention.

The cam member 186 and the cam follower 190 are positioned to permit controlled rotation of the central leg connecting member 162 along with the left and right interconnected leg rotation discs 138 and leg members 16, 18 as the legs 16, 18 pivot from the standing position of FIG. 1 to the sitting or pivoting position of FIGS. 2 and 4; the hook portion 188 of the cam member 186 contacting the curved portion 194 of the cam follower 190 and moving along the length of the cam follower 190 as the central leg connecting member 162 rotates from the position of FIG. 3 corresponding to a standing position to the pivoted sitting position of FIG. 4.

In the standing position of FIG. 3, the leg members 16, 18 are held in the standing position by the holding contact of spaced legs 68, 70 of the sitting mechanism 60 in engagement with the extending arms 160 of the central leg control member 162. Thus, the leg members 16, 18 are held against the tendency to pivot provided by the weighted section 132 of the leg members 16, 18. When the sitting mechanism 60 is moved to the rearward position in response to the rotation of the arm members 12, 14 and released after a time interval by the suction cup 114, the sitting mechanism 60 traverses from the rearward to forward positions and the spaced legs 68, 70 are moved from engagement with the extending arms 16. Thus, the leg control mechanism 130 is free to rotate and a sitting sequence is initiated. As the central leg connecting control member 162 rotates in the direction shown from FIGS. 3 to 4, extending pins 152, 154 of the leg control disc 138 rotate within the passages 174, 176 of the torso mounting disc 164 and pivotal movement is transmitted through pin 136 and the walking pin 150 to the leg members 16, 18. The leg members 16, 18 are affixed to the extending pins 136 by suitable fastening means 193. With the central leg interconnecting control member 162 free to rotate, the weighted leg members 16, 18 due to the positioning of the weighted sections 132 causes the doll 10 to sit down with pivoting of the leg members 16, 18 through pin 136 and about the central pivot pin 142.

In the standing position (FIG. 3), the upper pin 152 of the leg control disc 138 is positioned to the extreme lower end 177 of the arcuate passage 176. Similarly, the lower pin 154 is positioned to the lower end of the passage 174. Thus, as the central leg interconnecting control member 162 is released by the sitting mechanism 60, the leg interconnecting control member 162 is released and moves upward as the pins 152, 154 move upward in the respective passages 174, 176 of the torso mounting disc 164. Then, the leg interconnecting control member 162, leg control discs 138 and the attached leg members 16, 18 are pivoted to the sitting position. The passage section 177 of the arcuate passage 176 extends toward the center of the torso mounting disc 164 and provides a detented or latched standing position in combination with the sitting control mechanism 60.

Turning now to a discussion of the walking action of the doll 10, the walking control pin 150 is shown in FIG. 5 in the sitting configuration. The walking control pin 150 is inserted into the hole 146 of the leg control disc 138 for sitting operation and withdrawn for walking operation. The walking control pin 150 includes a narrowed shaft portion 194 extending into the recess 144 of the leg member 16 through a passage 195 and a widened flange 196 at the end of the narrowed shaft 194. A shaft portion 198 of the walking control pin 150 extends beyond the flange 196 and is dimensioned to fit through hole 146 of the leg control disc 138. The flanged portion 196 provides a controlled stop to insertion and withdrawal of the walking control pin 150 as the flanged portion alternately contacts the leg control disc 138 or the bottom of the recess 144.

Thus, to condition the doll 10 to a walking mode of operation, the control pin 150 is positioned by the user to the outward walking position so that the leg members 16, 18 pivot about the lower pivot pin 136 of the mounting disc 138. As the leg members 16, 18 pivot, the elongated recess 140 provides for movement of the leg members about the stationary extending pin 142 of the leg control disc 138. Thus, as the user holds the doll 10 by the arm members 12, 14 and one of the leg members is lifted off the walking surface, the lifted leg member in accordance with the weighted portion 132 pivots to position the lifted leg member in front of the doll to simulate a step. Thus, alternate lifting of the leg members 16, 18 off the walking surface simulates walking motion by the doll 10.

The foregoing detailed description has been given for clearness of understanding only and no unnecessary limitations should be understood therefrom as some modifications will be obvious to those skilled in the art.

We claim:

1. An articulated doll having limb members and a torso and capable of assuming a sitting position from a standing position without the assistance of the user, said doll comprising:

means within said doll torso for moving said doll from a standing to a sitting position, said moving means comprising pivotal leg members being pivoted with respect to said torso;

means for controlling operation of said moving means, said controlling means comprising means for retaining said pivotal leg members in a standing position and rotatable means extending from the outer surface of said doll torso and being actuated by the user of said doll to operate said controlling means; and means within said doll for delaying operation of said moving means after operation of said controlling means.

2. The articulated doll of claim 1 wherein said rotatable means comprises rotatable arm members and an actuator assembly interconnected for rotation with said arm members.

3. The articulated doll of claim 1 or 2 wherein said moving means further comprises a rotatable leg control assembly interconnected with said pivotal leg members and being responsive to said controlling means.

4. The articulated doll of claim 3 wherein said moving means includes a predetermined unequal mass distribution to impart pivotal movement to said leg members upon operation of said controlling means.

5. The articulated doll of claim 4 wherein said unequal mass distribution comprises weighted sections of said leg members.

6. The articulated doll of claim 3 wherein said retaining means comprises means for contacting said leg control assembly to restrain rotation of said leg control assembly.

7. The articulated doll of claim 6 wherein said controlling means further comprises means for latching said retaining means in a first position to restrain rotation of said leg control assembly, said latching means comprising a control carried by said doll torso and being operable by said user to latch said retaining means.

8. The articulated doll of claim 7 wherein said retaining means is positioned from said first restraining position to a second position wherein said latching means is rendered inoperable and said delay means is rendered operative.

9. The articulated doll of claim 8 wherein said delay means comprises a suction cup carried by said doll torso and an engaging surface of said retaining means to create a holding effect with said suction cup.

10. The articulated doll of claim 9 wherein said retaining means further comprises means for biasing said retaining means away from said second position in a direction toward said first position.

11. The articulated doll of claim 10 wherein said retaining means in said second position restrains rotation of said leg control assembly.

12. The articulated doll of claim 11 wherein said retaining means after operation of said delay means is urged by said biasing means from said second position past said first position to a third position wherein said retaining means permits rotation of said leg control assembly.

13. The articulated doll of claim 12 wherein said second position is toward the rear of said doll torso with respect to said first position and said third position is toward the front of said doll torso with respect to said first position.

14. An articulated doll comprising:

a torso;

leg members mounted for pivotal movement with respect to said torso;

means for controlling movement of said leg members from a standing position of said doll to a sitting position;

means for retaining said doll in a standing position and preventing operation of said leg controlling means; and means for releasing said retaining means and rendering said controlling means operative, said releasing means being controlled by the arm members of said doll, said releasing means further comprising means within said doll for delaying operation of said retaining means after operation of said arm members.

15. The articulated doll of claim 14 wherein said controlling means comprises a predetermined uneven distribution of mass of said leg members and pivotal mounting means carried by said doll torso interconnecting said leg members to said retaining means.

16. The articulated doll of claim 14 or 15 further comprising walking control means positionable between a first sitting control position and a second walking control position for providing pivotal movement of said leg members with respect to said controlling means in said second walking position and for providing movement with said controlling means in said first sitting control position.

17. The articulated doll of claim 16 wherein said controlling means includes a receiver portion and said walking control means comprises a pin for insertion into said receiver portion in said first sitting control position and withdrawl from said receiver portion in said second walking control position.

* * * * *